US009201443B2

(12) United States Patent
Saito et al.

(10) Patent No.: US 9,201,443 B2
(45) Date of Patent: Dec. 1, 2015

(54) ACCELERATOR DEVICE

(71) Applicant: DENSO CORPORATION, Kariya, Aichi-pref. (JP)

(72) Inventors: Takehiro Saito, Anjo (JP); Haruhiko Suzuki, Anjo (JP); Masahiro Makino, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/322,196

(22) Filed: Jul. 2, 2014

(65) Prior Publication Data

US 2015/0007684 A1 Jan. 8, 2015

(30) Foreign Application Priority Data

Jul. 2, 2013 (JP) ..... 2013-138697

(51) Int. Cl.

| | |
|---|---|
| ***G05G 1/44*** | (2008.04) |
| ***G05G 1/30*** | (2008.04) |
| ***G05G 5/05*** | (2006.01) |

(52) U.S. Cl.

CPC .. *G05G 1/30* (2013.01); *G05G 1/44* (2013.01); *G05G 5/05* (2013.01); *Y10T 74/20534* (2015.01)

(58) Field of Classification Search

USPC ..... 74/512–514, 560; 180/274

See application file for complete search history.

(56) References Cited

U.S. PATENT DOCUMENTS

| | | | | |
|---|---|---|---|---|
| 6,220,222 | B1 * | 4/2001 | Kalsi | 123/399 |
| 6,575,053 | B2 * | 6/2003 | Menzies | 74/513 |
| 2014/0096639 | A1 | 4/2014 | Saito et al. | |

* cited by examiner

*Primary Examiner* — Thomas Diaz

(74) *Attorney, Agent, or Firm* — Nixon & Vanderhye P.C.

(57) ABSTRACT

An accelerator device includes a first cover that provides an internal space for housing a return spring and a failure region where the first cover engages a second cover. The failure region has a thickness configured to be thinner than a thickness of a body of the first cover. When a pedal rotates to open an accelerator, a second cover side friction member creates a force that pushes the second cover toward an outside of the device. The force is relayed to a contact portion of the first cover via a contact portion of the second cover and causes a failure of the failure region. As a result, the return spring is prevented from falling out of the internal space when the body breaks.

7 Claims, 4 Drawing Sheets

ACCELERATOR DEVICE

CROSS REFERENCE TO RELATED APPLICATION

The present application is based on and claims the benefit of priority of Japanese Patent Application No. 2013-138697, filed on Jul. 2, 2013, the disclosure of which is incorporated herein by reference.

TECHNICAL FIELD

The present disclosure relates to an accelerator device.

BACKGROUND INFORMATION

An accelerator pedal of a vehicle has a hysteresis mechanism, which sets a force difference between a pedal depression force at a pedal depressing time and a pedal depression force at a pedal releasing time. For example, a patent document 1 (i.e., Japanese Patent application No. 2012-222056) discloses an accelerator pedal device that is equipped with a friction member disposed at a position between a pedal boss that rotates together with a shaft and a support member that supports the rotating shaft.

The friction member of the accelerator pedal device in the patent document 1 applies a pressing force from the friction member itself to an inner wall of the support member according to a magnitude of the pedal depression force at the pedal depressing time. If the pressing force from the friction member is excessive, the support member breaks and an accelerator pedal return spring housed in an inside of the support member is exposed to an outside of the support member. When the return spring is exposed to the outside of the support member, the return spring may easily fall out of the support member, leaving the accelerator pedal in a state where the accelerator pedal may not return to a fully closed position.

SUMMARY

It is an object of the present disclosure to provide an accelerator device which prevents an accelerator pedal return spring from falling out of a return spring housing when the return spring housing breaks.

In an aspect of the present disclosure, the accelerator device has a shaft, a boss portion, a pedal, a friction member, a rotation angle detector, and a biasing member. The support member is attachable to a vehicle body. The shaft is rotatably supported by the support member and rotatable in an accelerator opening direction and an accelerator closing direction, which are opposite to each other. The boss portion is attached onto an outer wall of the support member and rotatable integrally with the shaft. The pedal is connected to the boss portion and actuatable by a driver. The friction member is positioned between the boss portion and the support member, and is pressed against an inner wall of the support member when the boss portion rotates in the accelerator opening direction. The rotation angle detector detects a rotation angle of the shaft relative to the support member. The biasing member biases the shaft to rotate in the accelerator closing direction. The support member includes (i) a housing that supports one end portion of the shaft, (ii) a first cover defining an internal space in which the biasing member is housed, and (iii) a second cover engaging the first cover, supports an other end portion of the shaft, and receives a pressing force from the friction member. The first cover has a failure region that fails when an excessive pressing force exceeding a threshold pressing force is applied to the first cover from the friction member via the second cover.

Further, a body section of the first cover defines the internal space, and the failure region is configured to have a thickness that is thinner than the body section.

Additionally, the first cover includes a concave cavity in which (i) a bottom of the concave cavity is the failure region and (ii) an opening of the concave cavity opens into the internal space, and the second cover includes a projected portion that is inserted into the concave cavity.

Even further, the first cover has a contact portion that contacts the second cover when the pressing force is applied to the second cover, and the contact portion is positioned a distance away from the failure region.

Moreover, the failure region and the contact portion are connected by a connection portion that includes a sloped surface, and the sloped surface is positioned diagonal relative to a pressing force application direction along which the pressing force is applied.

Yet further, the failure region is configured to have a thickness that is thinner than the second cover.

In the accelerator device of the present disclosure, the first cover that forms the internal space, in which the biasing member is housed, engages with the second cover. The second cover receives the pressing force from the friction member according to the rotation of the return boss portion in the accelerator opening direction, and the pressing force from the friction member is applied in a direction toward an outside of the accelerator device. When the pressing force applied to the first cover via the second cover becomes excessively large, the failure region of the first cover fails (i.e., deforms, bends, cracks, breaks, etc.) which prevents the breakage of a body portion of the first cover. In such a structure, an exposure of the biasing member to an outside of the first cover is prevented, thereby (i) keeping the biasing member from falling out (i.e., from within the internal space) and (ii) ensuring "returnability" of the accelerator device, which returns the accelerator device to a fully closed state.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
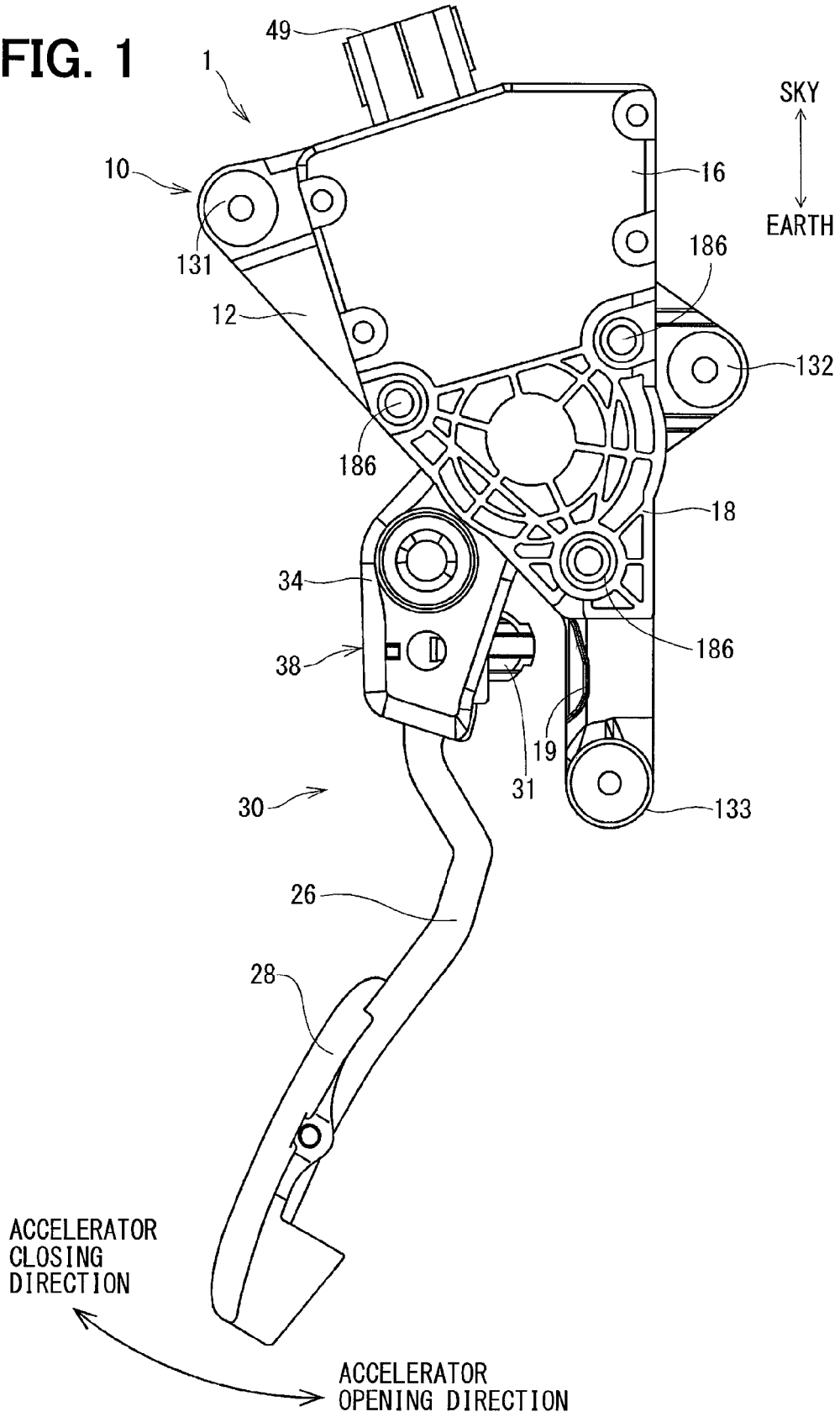
FIG. 1 is a side view of an accelerator device in a first embodiment of the present disclosure.

Hereafter, the embodiment of the present disclosure is described based on the drawings.

One Embodiment

An accelerator device in one embodiment of the present disclosure is described with reference to FIGS. 1 to 4. The accelerator device 1 is an input device which is operated by a driver of a vehicle for determining a valve opening degree of a throttle valve of an engine in the vehicle (not illustrated). The accelerator device 1 is an electronic type device, and transmits to an electrical control unit (not illustrated) an electric signal indicative of an amount of depression (i.e., pressing) of a pedal 28 by a driver of the vehicle. The electrical control unit drives a throttle valve by using a throttle actuator (not illustrated) based on the amount of depression of the pedal 28 or based on the other information.

The accelerator device 1 is provided with a support member 10, a shaft 20, an operating member 30, a return spring 39, a rotation angle sensor 40, a hysteresis mechanism 50, and the like. Hereafter, a "sky side" indicates a top side of each of the drawings in FIG. 1 to FIG. 4, and an "earth side" indicates a bottom side of each of the drawings in FIG. 1 to FIG. 4.

The support member 10 has an internal space 11 that houses the shaft 20, the return spring 39, the rotation angle sensor 40, the hysteresis mechanism 50, and the like. On the earth side of the support member 10, a communication hole 111 is provided which allows communication between an inside and an outside of the internal space 11 and defines a movable range of the operating member 30 to be mentioned later. The support member 10 comprises a housing 12, a first cover 16, a second cover 18, together with other parts.

The housing 12 is a resin-made member and includes a bearing segment 13 that rotatably bears one end portion 201 of the shaft 20, a front segment 17 that is in connection with the bearing segment 13 and positioned on a front side of the accelerator device 1, a rear segment 15 that faces the front segment 17, and an top segment 14 that connects the bearing segment 13, the front segment 17, and the rear segment 15 on the sky side of the accelerator device 1. For the durability of the housing 12 against an external force, the bearing segment 13, the front segment 17, the rear segment 15, and the top segment 14 respectively have a web-shaped ribbing on their outside walls (see FIG. 1).

The bearing segment 13 has an opening formed thereon, into which the one end portion 201 of the shaft 20 is inserted. The shaft 20 is disposed to be rotatable in an inside of the opening. That is, an inner wall of the opening serves as a bearing 130 for the one end portion 201.

Installation portions 131, 132, and 133 are formed on the housing 12. A bolt-hole is formed on each of the installation portions 131, 132, and 133. The accelerator device 1 is attached to a vehicle body 5 with a bolt (not-illustrated) that is inserted into the bolt-hole.

A full-opening-side stopper 19 having a concave shape is formed on the earth side of the rear segment 15. When a full-opening-side bumper 31 in a convex shape formed on the operating member 30 abuts on the full-opening-side stopper 19, such an abutment regulates (i.e., restricts) a rotation angle of the operating member 30 at an accelerator full open position. The accelerator full open position is set as a position at which the amount of depression of the operating member 30 by a driver, i.e., an accelerator opening degree, is equal to 100[%].

The first cover 16 and the second cover 18 are formed to be substantially in parallel with the bearing segment 13. The first cover 16 as a "second cover" prevents a foreign substance from entering into the internal space 11. The first cover 16 is formed in an approximately rectangular board shape, and is in connection with an opposite edge of each of the top segment 14, the rear segment 15, and the front segment 17, which are opposite from the bearing segment 13. One side of the first cover 16 close to the second cover 18 engages with the second cover 18. An engagement part between the first cover 16 and the second cover 18 is described later in more details.

The second cover 18 has a triangular blade shape, substantially. The second cover 18 as "a first cover" in the claims prevents a foreign substance from entering into the internal space 11, as well as rotatably supporting other end portion 202 of the shaft 20. The second cover 18 is fixed onto an opposite side of the rear segment 15 and the front segment 17, which is opposite to a side of those segments 15, 17 being fixed onto the bearing segment 13 with a bolt 186. The second cover 18 has a concave region formed thereon for rotatably supporting the other end portion 202 of the shaft 20. That is, an inner wall of such a concave region serves as a bearing 180 for supporting the other end portion 202 of the shaft 20. For the durability of the cover 18 against an external force, the second cover 18 has on its outer wall a web-shaped ribbing (see FIG. 1).

The shaft 20 is horizontally disposed on the earth side of the accelerator device 1. A sensor receiving recess 22 which houses a detecting element of the rotation angle sensor 40 is formed on the one end portion 201 of the shaft 20.

The shaft 20 rotates in a preset angular range between an accelerator fully closed position and an accelerator full open position according to a torque that is inputted from the operating member 30 by a driver's pedal depression. The accelerator fully closed position is set as a position at which the amount of depression of the operating member 30 by a driver, i.e., an accelerator opening degree, is equal to 0[%].

Figure 2:
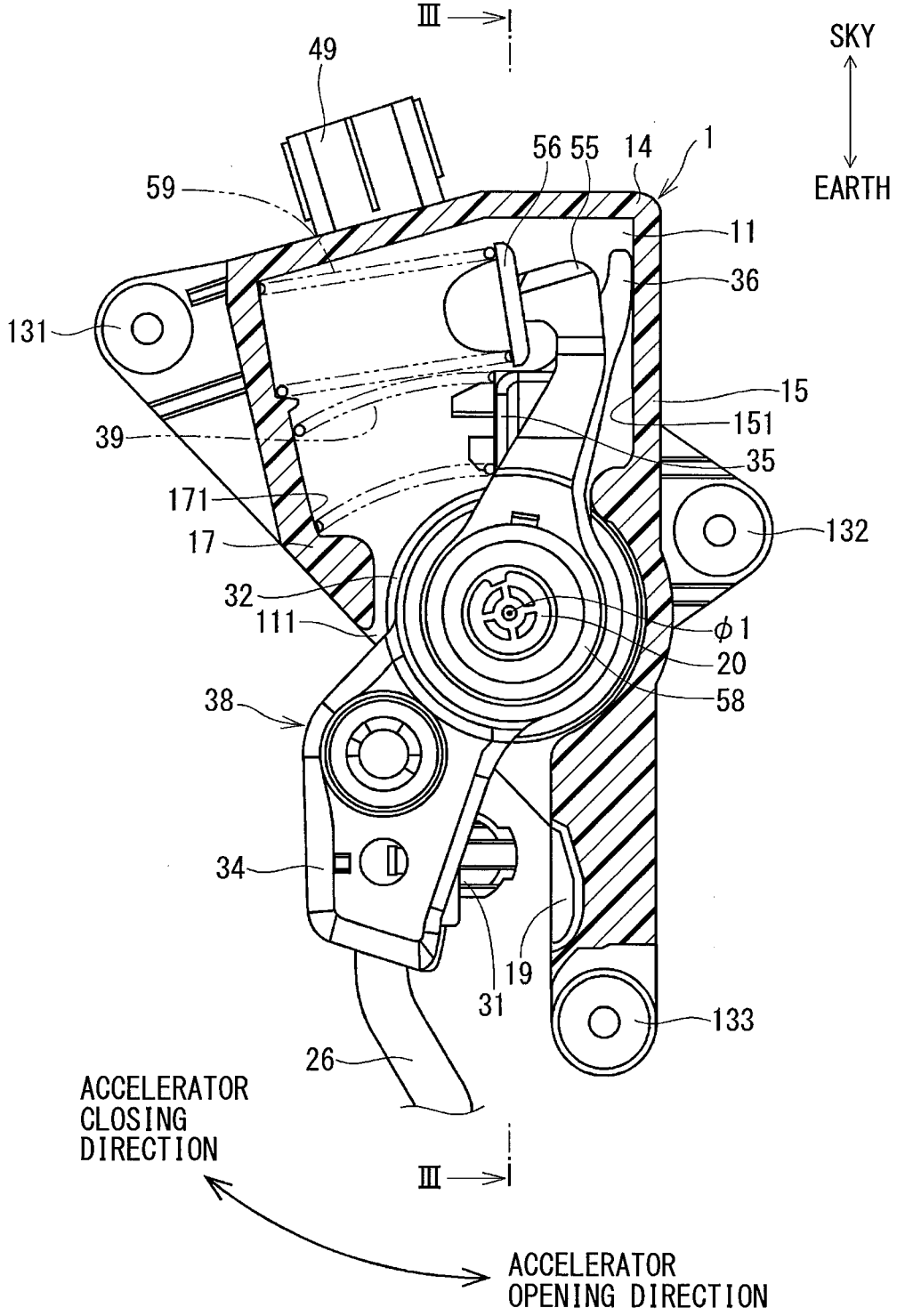
FIG. 2 is a sectional view of the accelerator device in the first embodiment of the present disclosure.

Hereafter, when the operating member 30 is operated from the accelerator fully closed position toward the accelerator full open position, such a rotation direction of the operating member 30 is described as an "accelerator opening direction" as shown in FIG. 2. Further, when the operating member 30 is operated from the accelerator full open position toward the accelerator fully closed position, such a rotation direction of the operating member 30 is described as an "accelerator closing direction".

The operating member 30 comprises (i) a rotating body 38 that has a single integrated body including a return boss portion 32, an arm connecting portion 34, a spring holder 35, and a full-closing-side stopper 36, (ii) the pedal 28, and (iii) a pedal arm 26.

The return boss portion 32 has a ring shape, and is disposed at a position between the bearing segment 13 and the second cover 18. The return boss portion 32 is fixed onto an outer wall of the shaft 20 by press-fitting, for example.

A first spiral bevel gear 321 is formed as one body with a side face of the return boss portion 32 which faces the second cover 18. The first spiral bevel gear 321 is formed in plural pieces, i.e., as two or more gears, at an equal interval in the circumference of the return boss portion 32. A degree of protrusion of the first spiral bevel gear 321 toward a rotor 54 of the hysteresis mechanism 50 is large at a full-close side end of a circumferential position of the gear 321 (which is close to the accelerator fully closed position in the accelerator closing direction), and a tip of the gear 321 is formed as a sloped surface that comes close to the rotor 54 at such an end position.

On a side face of the return boss portion 32 facing the housing 12, a housing side friction member 323 is provided. The housing side friction member 323 has a ring shape, and is disposed at a position between the return boss portion 32 and an inner wall of the bearing segment 13 on radial outside of the shaft 20. When the return boss portion 32 goes afar, i.e., away, from the rotor 54, that is, when the return boss portion 32 is pressed in a direction toward the bearing segment 13, the return boss portion 32 frictionally engages with the housing side friction member 323. The frictional force between the return boss portion 32 and the housing side friction member 323 is a resistance for rotation of the return boss portion 32.

The arm connecting portion 34 is formed to have its one end connected with a side face of a radial outside of the return boss portion 32, and to have its other end extending toward an outside of the support member 10 through the communication hole 111.

The full-closing-side stopper 36 extends from the return boss portion 32 in an upward direction toward the sky in the internal space 11. The full-closing-side stopper 36 regulates the rotation of the pedal 28 to stop at the accelerator fully closed position in the accelerator closing direction, when the stopper 36 contacts an inner wall 151 of the rear segment 15.

The spring holder 35 has a convex shape, and is disposed at a position between the return boss portion 32 and the full-closing-side stopper 36 on one side close to the front segment 17. The spring holder 35 engagingly holds one end of the return spring 39.

The pedal arm 26 is formed to have its one end connected with the arm connecting portion 34, and to have its other end extending in the earth direction. The other end of the pedal arm 26 is connected with the pedal 28. The pedal 28 converts a driver's pedal depression force into a rotation torque that centers on a rotation axis $\phi 1$ of the shaft 20, and transmits the torque to the shaft 20 via the rotating body 38.

When the pedal 28 rotates in the accelerator opening direction, the rotation angle of the shaft 20 in the accelerator opening direction increases relative to a base position which is defined as the accelerator fully closed position, and the accelerator opening degree corresponding to this rotation angle also increases. When the pedal 28 rotates in the accelerator closing direction, the rotation angle of the shaft 20 decreases, and the accelerator opening degree also decreases.

The return spring 39 comprises a coil spring, for example. The other end of the return spring 39 is engagingly held by an inner wall 171 of the front segment 17. The return spring 39 is "a biasing member" that biases the operating member 30 in the accelerator closing direction. The biasing force applied from the return spring 39 to the operating member 30 increases when the rotation angle of the operating member 30, i.e., the rotation angle of the shaft 20, increases. Further, this biasing force is configured to return the operating member 30 and the shaft 20 to the accelerator fully closed position, regardless of the rotation position of the operating member 30.

The rotation angle sensor 40 comprises a yoke 42, a pair of magnets 44 and 46 having opposite magnetic poles, a Hall element 48, and the like. The yoke 42 consists of magnet and has a cylinder shape. The yoke 42 is fixed onto an inner wall of the sensor receiving recess 22 of the shaft 20. The magnets 44 and 46 are disposed respectively on a radially inner side of the yoke 42 to face each other with the rotation axis $\phi 1$ interposed therebetween. That is, the magnets 44 and 46 are fixed on an inner wall of the yoke 42. The Hall element 48 is disposed at a position in between the magnet 44 and the magnet 46. The rotation angle sensor 40 is equivalent to "a rotation angle detector" in the claims.

When a magnetic field passes through the Hall element 48 in which an electric current is flowing, an electromotive force (i.e., a voltage) is developed in the Hall element 48. This phenomenon is called as a Hall effect. The density of the magnetic flux which passes through the Hall element 48 changes as the magnets 44 and 46 rotate around the rotation axis $\phi 1$ together with the shaft 20. The magnitude of the developed voltage is proportional to the magnetic flux density passing through the Hall element 48. The rotation angle sensor 40 detects a relative rotation angle of the Hall element 48 relative to the magnets 44 and 46, that is, detects a rotation angle of the shaft 20 against the support member 10. The rotation angle sensor 40 transmits, to an external electrical control unit (not illustrated), an electric signal indicative of the detected rotation angle via an external connector 49 that is disposed on the sky side of the accelerator device 1.

The hysteresis mechanism 50 comprises the rotor 54, a second cover side friction member 58, a hysteresis spring 59, together with other parts.

The rotor 54 is disposed at a position between the return boss portion 32 and the second cover 18 on a radial outside of the shaft 20. The rotor 54 has a ring shape. The rotor 54 is rotatable relative to the shaft 20 and to the return boss portion 32, and may come close to or may go away from the return boss portion 32. A second spiral bevel gear 541 is formed in one body on a side face of the return boss portion 32 of the rotor 54. The second spiral bevel gear 541 is formed at an equal interval in the circumference of the return boss portion 32 in plural pieces, i.e., as two or more gears. A degree of protrusion of the second spiral bevel gear 541 toward the return boss portion 32 increases as a circumferential position of the gear 541 comes close to the accelerator full open position in the accelerator opening direction, and a tip of the gear 541 is formed as a sloped surface that comes close to the rotor 54 as a circumferential position of the gear 541 comes close to the accelerator full open position in the accelerator opening direction.

The first spiral bevel gear 321 and the second spiral bevel gear 541 abut on each other by their sloped surfaces in the circumferential direction, for transmitting rotation from one to the other, or between the return boss portion 32 and the rotor 54. That is, the rotation of the return boss portion 32 in the accelerator opening direction is transmittable to the rotor 54 via the first spiral bevel gear 321 and the second spiral bevel gear 541. Further, the rotation of the rotor 54 in the accelerator closing direction is transmittable to the return boss portion 32 via the second spiral bevel gear 541 and the first spiral bevel gear 321.

Further, when the rotation position of the return boss portion 32 is on an accelerator full open position side of the accelerator fully closed position, the sloped surfaces of the first spiral bevel gear 321 and the second spiral bevel gear 541 engage with each other, which results in a moving away of the return boss portion 32 and the rotor 54 from each other. In such a situation, the first spiral bevel gear 321 presses the return boss portion 32 toward a housing 12 side with a greater force as the rotation angle of the return boss portion 32 from the accelerator fully closed position increases. Further, the second spiral bevel gear 541 presses the rotor 54 toward a second cover 18 side with a greater force as the rotation angle of the return boss portion 32 from the accelerator fully closed position increases.

The second cover side friction member 58 has a ring shape, and is disposed at a position between the rotor 54 and the second cover 18 on a radial outside of the shaft 20. When the rotor 54 is urged in the direction away from the return boss portion 32, i.e., pressed in a direction toward the second cover 18, the second cover side friction member 58 is pressed onto an inner wall 187 of the second cover 18 (refer to FIG. 4). Thereby, the second cover side friction member 58 is frictionally engaged with the rotor 54. The frictional force between the second cover side friction member 58 and the rotor 54 acts as a rotational resistance force against the rotation of the rotor 54. The second cover side friction member 58 is equivalent to "a friction member" in the claims.

The hysteresis spring 59 comprises a coil spring. One end of the hysteresis spring 59 is engagingly held by a spring receiving member 56 which is supported by an arm 55 provided on the sky side of the rotor 54. The other end of the hysteresis spring 59 is held by the inner wall 171 of the front segment 17. The hysteresis spring 59 biases the rotor 54 in the accelerator closing direction. The biasing force of the hysteresis spring 59 increases, when the rotation angle of the rotor 54 increases. The torque which is received by the rotor 54 according to the biasing force of the hysteresis spring 59 is transmitted to the return boss portion 32 via the second spiral bevel gear 541 and the first spiral bevel gear 321.

Figure 4:
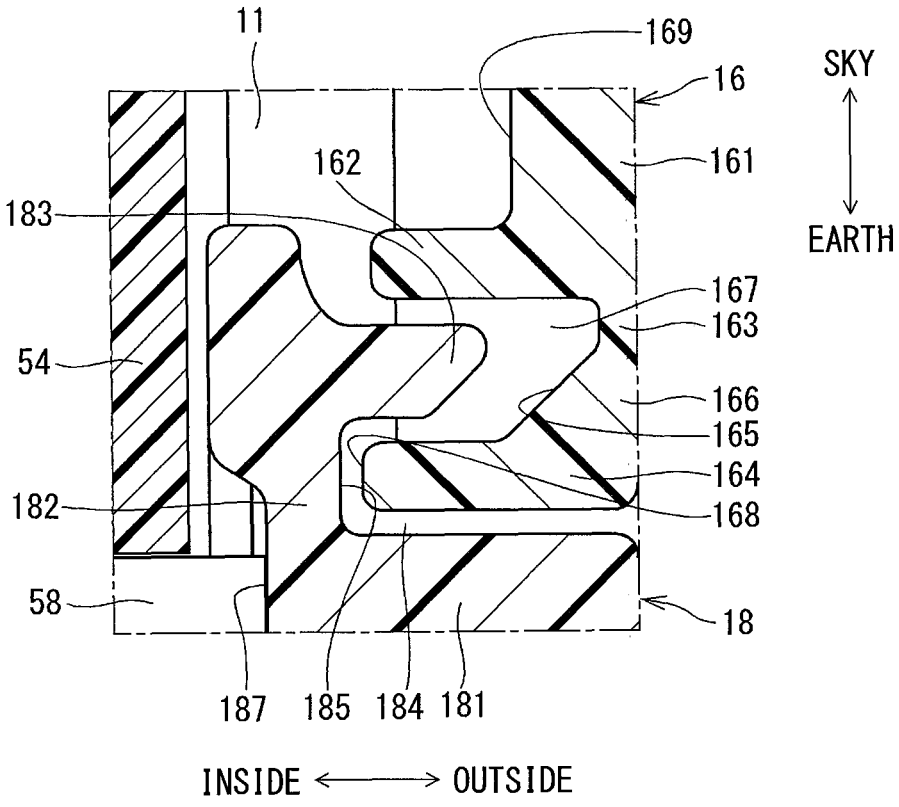
FIG. 4 is an enlarged view of a part that is marked as a part IV in FIG. 3.

Here, in one embodiment of the accelerator device 1, the shape of an engagement part between the first cover 16 and the second cover 18 has an inventive feature. Hereafter, this inventive feature is described in detail based on FIG. 4. In FIG. 4, a right-hand side of illustration is an outside of the accelerator device 1, and a left-hand side of illustration is an inside of the accelerator device 1.

Figure 3:
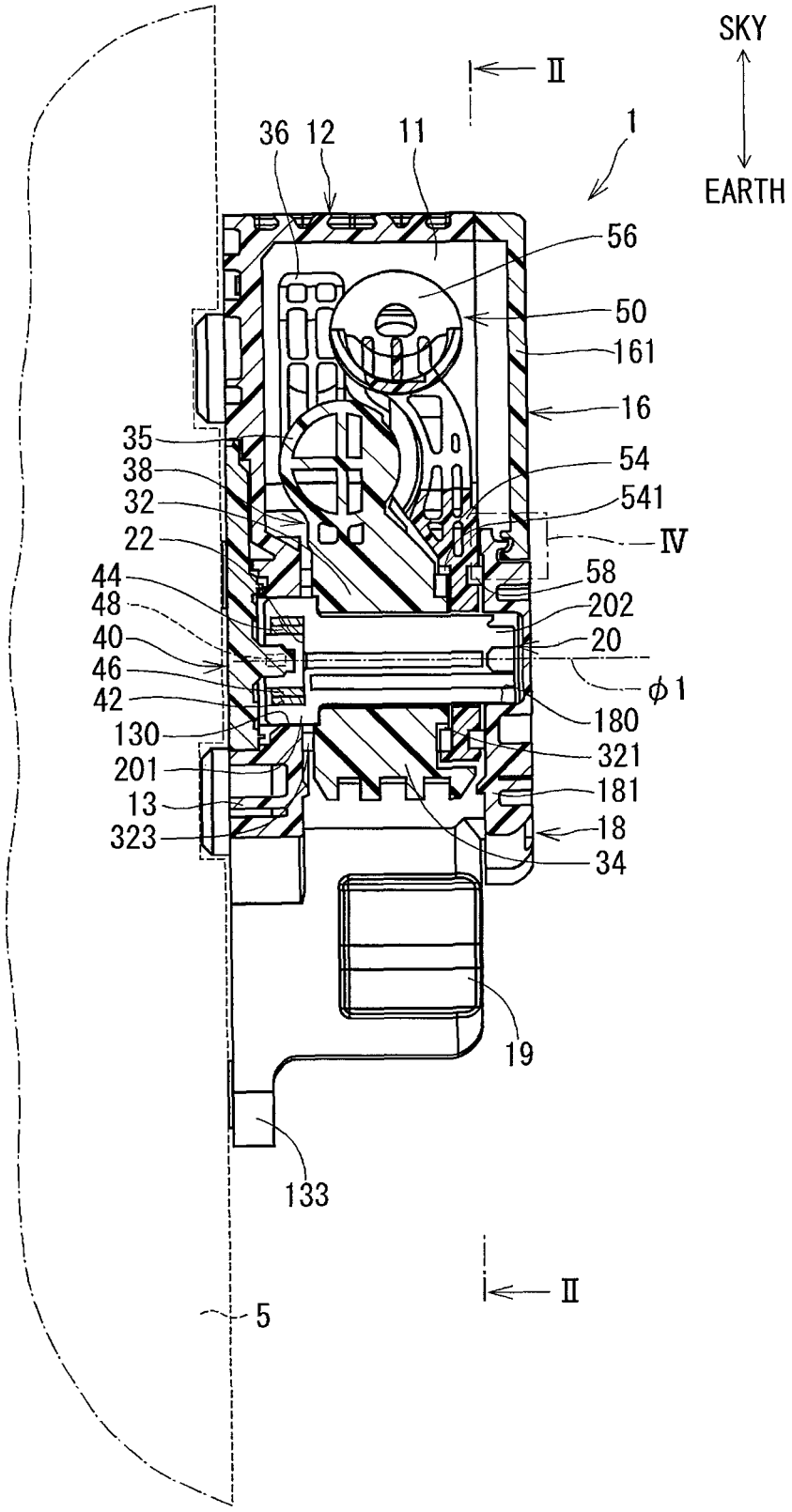
FIG. 3 is a sectional view in a line of FIG. 2.

FIG. 4 is an enlarged view of FIG. 3 at a part IV, that is, a sectional view of the engagement part between the first cover 16 and the second cover 18.

An edge of the first cover 16 has a concave shape on one side close to the second cover 18, which serves as an opening toward the internal space 11. The first cover 16 comprises a body portion 161, a first cover first projected portion 162, a failure region 163, a first cover second projected portion 164, and the like.

The body portion 161 is formed in a flat board shape, and is connected with one end of each of the top segment 14, the rear segment 15, and the front segment 17 of the housing 12, which is an opposite end of the other end by which each of the parts 14, 15, 17 is connected with the bearing segment 13.

The first cover first projected portion 162 is disposed on one side of the body portion 161 which faces the second cover 18. The first cover first projected portion 162 is formed to project from an inner wall 169 of the body portion 161 toward the internal space 11.

The failure region 163 is disposed on one side of the first cover first projected portion 162 which faces to the second cover 18. The failure region 163 is configured to have a thickness that is thinner than the body portion 161 and the second cover 18 that is mentioned later.

The first cover second projected portion 164 is disposed on one side of the failure region 163 which faces the second cover 18. The first cover second projected portion 164 is formed to project from the inner wall 169 by a same degree as the first cover first projected portion 162 toward the internal space 11. The first cover second projected portion 164 is equivalent to "a contact portion" in the claims.

At a position between the first cover second projected portion 164 and the failure region 163, a connection portion 166 that has a sloped surface 165 is provided, and the sloped surface 165 is diagonal relative to the sky-earth (i.e., vertical) direction. The sloped surface 165 has a flat board shape, and connects an inner wall of the first cover second projected portion 164 and an inner wall of the failure region 163. The first cover first projected portion 162, the failure region 163, and the first cover second projected portion 164 form a concave cavity 167 into which a second cover projected portion 183 of the second cover 18 is inserted.

An edge of the second cover 18 has a concave shape on a side facing the first cover 16, which serves as an opening towards an outside of the accelerator device 1. The second cover 18 comprises a body part 181, a second cover contact portion 182, a second cover projected portion 183, together with other parts.

The body part 181 has a flat board shape, and is connected with one end of each of the rear segment 15 and the front segment 17 of the housing 12, which is an opposite end of the other end by which each of the rear segment 15 and the front segment 17 is connected with the bearing segment 13.

The second cover contact portion 182 is disposed on a side of the body part 181 facing the first cover 16, and is disposed on an inside of the accelerator device 1.

The second cover projected portion 183 is disposed on the side of the second cover contact portion 182 facing the first cover 16. The body part 181, the second cover contact portion 182, and the second cover projected portion 183 forms a cylinder-with-bottom space 184 into which the first cover second projected portion 164 of the first cover 16 is inserted. The second cover projected portion 183 is equivalent to "a projected portion" in the claims.

Next, the operation of the accelerator device 1 is described.

When the pedal 28 is depressed, the operating member 30 rotates in the accelerator opening direction that centers on the rotation axis $\phi 1$ together with the shaft 20 according to the pedal depression force applied to the pedal 28. For a rotation of the shaft 20 in such a situation, the pedal depression force is required to generate a torque that is greater than a sum of two torques, that is, a sum of (i) a biasing torque by biasing forces of the return spring 39 and the hysteresis spring 59 and (ii) a resisting torque by the frictional forces of the housing side friction member 323 and the second cover side friction member 58.

The resisting torque by the frictional forces of the housing side friction member 323 and the second cover side friction member 58 acts as a resistance that resists a rotation of the pedal 28 in the accelerator opening direction when the pedal 28 is depressed. As a result, the pedal depression force at the time of depressing of the pedal 28 is greater than the pedal depression force at the time of releasing the pedal 28 when two pedal depression forces are compared with each other at the same rotation angle.

After depressing the pedal 28, in order to maintain the same degree of depressing of the pedal 28, the pedal depression force applied to the pedal 28 needs to counter only to a difference between the two torques, that is, a difference between (i) the biasing torque by biasing forces of the return spring 39 and the hysteresis spring 59 and (ii) the resisting torque by the frictional forces of the housing side friction member 323 and the second cover side friction member 58. That means, the driver may "relax" the pedal depression force just a little bit after the depressing of the pedal 28 to a certain degree, for the keeping of the same degree of depressing of the pedal 28 after the depressing of the pedal 28 to the certain degree. More practically, the resisting torques from the housing side friction member 323 and the second cover side friction member 58 act as a resistance that resists to a rotation of the pedal 28 in the accelerator closing direction, when the depressing of the pedal 28 is kept at a certain degree.

For the returning the pedal 28 to the accelerator fully closed position, the pedal depression force is controlled to be smaller than a difference between the two torques between (i) the biasing torque by biasing forces of the return spring 39 and the hysteresis spring 59 and (ii) the resisting torque by the frictional forces of the housing side friction member 323 and the second cover side friction member 58. When the pedal 28 is quickly returned to the accelerator fully closed position, the driver may only stop the depressing of the pedal 28, which causes no load for the driver. That is, when releasing the pedal 28, there is almost no burden posed on the driver. The resisting torque by the frictional forces of the housing side friction member 323 and the second cover side friction member 58 acts as a resistance that resists to a rotation of the pedal 28 in the accelerator closing direction 28 when the pedal 28 in a depressed state is released.

In case that the driver depresses the pedal 28 in an improper posture, or in case that the driver depresses the pedal 28 forcefully, for example, an excessive force is applied in a thrust direction of the shaft 20 due to the engagement between the first spiral bevel gear 321 and the second spiral bevel gear 541. When the second cover side friction member 58 is pressed onto the inner wall of the second cover 18 by such an excessive force, a pressing force which presses the second cover 18 toward the outside of the accelerator device 1 acts on the second cover 18. At such time, the outer wall 185 of the second cover contact portion 182 of the second cover 18 contacts the first cover second projected portion 164 of the first cover 16, which is, more practically, the inner wall 168 of the first cover second projected portion 164 on one side close to the internal space 11. Thereby, the pressing force acting on the second cover 18 is applied to the first cover 16 via a contact between the outer wall 185 and the inner wall 168.

The pressing force applied to the first cover 16 turns into a pressing force which presses the first cover 16 toward an outside of the accelerator device 1. If the pressing force exceeding a predetermined value is applied to the first cover 16, the failure region 163 configured to have a thickness thinner than other portions of the first cover 16 is firstly deformed or broken. Thereby, deformation or breakage of the first cover 16 is prevented. Therefore, exposure of the return spring 39 to an outside of the device 1 is prevented, and a drop of the return spring 39 to an outside of the device 1 is prevented.

The engagement part between the first cover 16 and the second cover 18 is formed as a labyrinth as shown in FIG. 4, which is defined by the concave cavity 167, the cylinder-with-bottom space 184, the second cover projected portion 183, and the first cover second projected portion 164. Thereby, intrusion of a foreign substance into the internal space 11 is prevented.

The first cover 16 has the connection portion 166 formed at a position between the first cover second projected portion 164 and failure region 163 to which the pressing force is applied. The connection portion 166 provides a distance between the first cover second projected portion 164 and the failure region 163 (i.e., the contact portion 164 is positioned a distance away from the failure region 163), which increases a torque on the failure region 163 by the pressing force applied to the first cover second projected portion 164. Further, the connection portion 166 has the planar sloped surface 165. Thereby, the strength of a portion at a proximity of the failure region 163 is improved, which leads to a guaranteed deformation/breakage of the failure region 163. Therefore, exposure of the return spring 39 is more securely prevented, and a drop of the return spring 39 to an outside of the device 1 is prevented in a more secured manner.

The failure region 163 is configured to have a thickness that is thinner than a thickness of the second cover 18. Thereby, before the failure of the second cover 18 or the like, the failure region 163 securely fails (i.e., deforms, bends, cracks, breaks, etc.). Therefore, the failure region 163 prevents an early deformation/breakage of the body portion 161 of the first cover 16 or the second cover 18.

Other Embodiments (a) According to the above-mentioned embodiment, the thickness of the failure region is configured to be thinner than the body part of the first cover or the second cover. However, the thickness of the failure region may be configured differently. The failure region may have any shape as long as the shape of the failure region allows an early deformation/breakage of the failure region prior to the deformation/breakage of the body part of the first cover or the second cover, when the pressing force is applied to the second cover.

(b) According to the above-mentioned embodiment, the engagement part at which the first cover and the second cover engage with each other is formed as a labyrinth that is defined by the concave space, the cylinder-with-bottom space, the second cover projected portion of the second cover, and the second projected portion of the first cover. However, the engagement part may be differently configured from such a structure.

(c) According to the above-mentioned embodiment, the connection portion is provided at a position between the failure region and the second projected portion, and the failure region and the second projected portion are positioned afar from each other. However, the failure region and the second projected portion may be connected without having the connection portion interposed therebetween.

(d) According to the above-mentioned embodiment, the connection portion is configured to have a plane sloped surface which is diagonal relative to the sky-earth (i.e., vertical) direction. However, the shape of the slope may be configured differently. The slope may have a curved shape surface. The shape of the slope may be any shape as long as the shape of the sloped surface increases the strength of the portion at the proximity of the failure region.

(e) According to the above-mentioned embodiment, the hysteresis mechanism is provided in the accelerator device. However, the hysteresis mechanism may be omitted from the accelerator device.

As mentioned above, although the present disclosure has been fully described in connection with preferred embodiment thereof with reference to the accompanying drawings, it is to be noted that various changes and modifications will become apparent to those skilled in the art, and such changes, modifications, and summarized scheme are to be understood as being within the scope of the present disclosure as defined by appended claims.

What is claimed is:

1. An accelerator device comprising:

a support member that is attachable to a vehicle body;

a shaft rotatably supported by the support member and rotatable in an accelerator opening direction and an accelerator closing direction, which are opposite to each other;

a boss portion attached onto an outer wall of the support member and rotatable integrally with the shaft;

a pedal connected to the boss portion and actuatable by a driver;

a friction member positioned between the boss portion and the support member, and pressed against an inner wall of the support member when the boss portion rotates in the accelerator opening direction;

a rotation angle detector detecting a rotation angle of the shaft relative to the support member; and a biasing member biasing the shaft to rotate in the accelerator closing direction, wherein the support member includes (i) a housing that supports one end portion of the shaft, (ii) a first cover defining an internal space in which the biasing member is housed, and (iii) a second cover engaging the first cover, supporting an other end portion of the shaft, and receiving a pressing force from the friction member, and the first cover has a failure region that fails when the friction member applies an excessive pressing force exceeding a threshold pressing force to the second cover, the threshold pressing force of the friction member causing the second cover to contact the first cover, and the contact with the second cover causing the first cover to fail at the failure region wherein the first cover has a contact portion that contacts the second cover when the pressing force is applied to the second cover, and the contact portion is positioned a distance away from the failure region.

2. The accelerator device of claim 1, wherein a body section of the first cover defines the internal space, and the failure region is configured to have a thickness that is thinner than the body section.

3. An accelerator device comprising:

a support member that is attachable to a vehicle body;

a shaft rotatably supported by the support member and rotatable in an accelerator opening direction and an accelerator closing direction, which are opposite to each other;

a boss portion attached onto an outer wall of the support member and rotatable integrally with the shaft;

a pedal connected to the boss portion and actuatable by a driver;

a friction member positioned between the boss portion and the support member, and pressed against an inner wall of the support member when the boss portion rotates in the accelerator opening direction;

a rotation angle detector detecting a rotation angle of the shaft relative to the support member; and a biasing member biasing the shaft to rotate in the accelerator closing direction, wherein:

the support member includes (i) a housing that supports one end portion of the shaft, (ii) a first cover defining an internal space in which the biasing member is housed, and (iii) a second cover engaging the first cover, supporting an other end portion of the shaft, and receiving a pressing force from the friction member;

the first cover has a failure region that fails when an excessive pressing force exceeding a threshold pressing force is applied to the first cover from the friction member via the second cover;

the first cover includes a concave cavity in which (i) a bottom of the concave cavity is the failure region and (ii) an opening of the concave cavity opens into the internal space, and the second cover includes, on one side close to the first cover, a projected portion that is inserted into the concave cavity.

4. The accelerator device of claim 1, wherein the failure region and the contact portion are connected by a connection portion that includes a sloped surface, and the sloped surface is positioned diagonal relative to a pressing force application direction along which the pressing force is applied.

5. The accelerator device of claim 1, wherein the failure region is configured to have a thickness that is thinner than the second cover.

6. The accelerator device of claim 1, wherein the first cover includes a concave cavity in which (i) a bottom of the concave cavity is the failure region and (ii) an opening of the concave cavity opens into the internal space, and the second cover includes, on one side close to the first cover, a projected portion that is inserted into the concave cavity.

7. An accelerator device comprising:

a support member that is attachable to a vehicle body;

a shaft rotatably supported by the support member and rotatable in an accelerator opening direction and an accelerator closing direction, which are opposite to each other;

a boss portion attached onto an outer wall of the support member and rotatable integrally with the shaft;

a pedal connected to the boss portion and actuatable by a driver;

a friction member positioned between the boss portion and the support member, and pressed against an inner wall of the support member when the boss portion rotates in the accelerator opening direction;

a rotation angle detector detecting a rotation angle of the shaft relative to the support member; and a biasing member biasing the shaft to rotate in the accelerator closing direction, wherein the support member includes (i) a housing that supports one end portion of the shaft, (ii) a first cover defining an internal space in which the biasing member is housed, and (iii) a second cover engaging the first cover, supporting an other end portion of the shaft, and receiving a pressing force from the friction member, and the first cover has a failure region that fails when an excessive pressing force exceeding a threshold pressing force is applied to the first cover from the friction member when the second cover contacts the first cover;

the first cover includes a concave cavity in which (i) a bottom of the concave cavity is the failure region and (ii) an opening of the concave cavity opens into the internal space, and the second cover includes, on one side close to the first cover, a projected portion that is inserted into the concave cavity.

* * * * *